US006477459B1

(12) United States Patent
Wunderlich

(10) Patent No.: US 6,477,459 B1
(45) Date of Patent: Nov. 5, 2002

(54) METHOD FOR INFORMING MOTOR VEHICLE DRIVERS

(75) Inventor: Wolfgang Wunderlich, Hildesheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/535,329

(22) Filed: Mar. 27, 2000

(30) Foreign Application Priority Data

Mar. 27, 1999 (DE) ..... 199 14 041

(51) Int. Cl.[7] ..... G08G 1/123

(52) U.S. Cl. ..... 701/209; 701/36; 701/117; 340/901; 73/178 R

(58) Field of Search ..... 701/209, 200, 701/117, 120, 36; 73/178 R; 340/901, 905

(56) References Cited

U.S. PATENT DOCUMENTS 4,878,218 A * 10/1989 Takada ..... 370/229
5,293,163 A * 3/1994 Kakihara et al. ..... 340/995
5,396,283 A * 3/1995 Taniguchi et al. ..... 348/149
5,825,769 A * 10/1998 O'Reilly et al. ..... 370/360
5,845,250 A * 12/1998 Vogten ..... 704/270
5,892,463 A * 4/1999 Hikita et al. ..... 340/995
5,908,464 A * 6/1999 Kishigami et al. ..... 701/208
5,933,094 A * 8/1999 Goss et al. ..... 340/905
5,959,577 A * 9/1999 Fan et al. ..... 342/357.13
6,023,653 A * 2/2000 Ichimura et al. ..... 701/208
6,064,318 A * 5/2000 Kirchner, III et al. ..... 340/905
6,178,374 B1 * 1/2001 Mohlenkamp et al. ..... 701/117
6,185,503 B1 * 2/2001 Sumizawa ..... 701/209
6,216,088 B1 * 4/2001 Schulz et al. ..... 701/209
6,233,518 B1 * 5/2001 Lee ..... 701/117
6,236,932 B1 * 5/2001 Fastenrath ..... 701/117
6,246,933 B1 * 6/2001 Bague ..... 701/35

OTHER PUBLICATIONS

Specifications For Radio Data System RDS For VHF.FM Sound Broadcasting, Tech. 3244–E, mrch 1984 of the European Broadcasting Union (EBU).

* cited by examiner

*Primary Examiner*—William A. Cuchlinski, Jr.
*Assistant Examiner*—Olga Hernandez
(74) *Attorney, Agent, or Firm*—Kenyon & Kenyon

(57) ABSTRACT

In a method for informing motor vehicle drivers, in which digitally coded traffic messages are received and buffered, a time stamp is stored in memory with each of the traffic messages received. A measure for the duration of the event and/or the change of its extent is derived from extents and the time stamps of stored traffic messages relating to the same event. The change is displayed.

5 Claims, 2 Drawing Sheets

| Clock Time | Type of Message | Content | TST | Trend |
|---|---|---|---|---|
| 12:00 p.m. | new message | "5 km traffic jam on Ax between ... and ..." | 12:00 p.m. | ./. |
| 12:25 p.m. | update | "5 km traffic jam on Ax between ... and ..." | 12:00 p.m. (unchanged since it is an update message) | "constant" |
| 12:50 p.m. | update | "5 km traffic jam on Ax between ... and ..." | 12:00 p.m. (unchanged since it is an update message) | "constant" |

Fig. 1

| Clock Time | Type of Message | Content | TST | Trend |
|---|---|---|---|---|
| 3:00 p.m. | new message | "3 km traffic jam on Ax between ... and ..." | 3:00 p.m. | ./. |
| 3:25 p.m. | update | "5 km traffic jam on Ax between ... and ..." | 3:00 p.m. (unchanged since it is an update message) | "increasing" |
| 3:50 p.m. | update | "7 km traffic jam on Ax between ... and ..." | 3:00 p.m. (unchanged since it is an update message) | "increasing" |

Fig. 2

METHOD FOR INFORMING MOTOR VEHICLE DRIVERS

FIELD OF THE INVENTION

The present invention relates to a method for informing motor vehicle drivers, digitally encoded traffic messages being received and buffered.

BACKGROUND INFORMATION

The Radio Data System (RDS) makes it possible to transmit supplemental and inaudible digital data in a data channel concurrently with broadcast programs. Specifications for the Radio Data System for FM radio broadcasting have been established in the printed publication Tech. 3244-E, March 1984 of the European Broadcasting Union (EBU) and elsewhere. Broadcast receivers with suitable RDS decoders can receive and decode transmitted data in addition to audio reception with the same receiver component. Thirty-two groups of 104 bits each are provided for the data transmission, each of the assigned groups being assigned to a specific service. Group 8a is presently provided for the transmission of digitally coded messages, traffic messages in particular.

The configuration and the encoding of such traffic messages are established in CEN ENV 12313-1 which is based on the proposed standard ALERT C, November 1990, published by RDS ATT ALERT Consortium. The essential elements of a traffic message are the location of the event and the event itself. This information is cataloged, i.e, a unique code is assigned to every traffic-relevant location and every traffic-relevant event. The chaining of the locations in a location database along existing roads reproduces the course. Aside from the customary equipment of a receiver with an RDS decoder, devices for decoding, storage, further processing and output of the traffic messages are required for utilization of the TMC (Traffic Message Channel).

Digitally coded traffic messages—also referred to hereinafter as TMC messages for the sake of simplicity—can be transmitted not only with the aid of the Radio Data System but rather also, for example, within Digital Audio Broadcasting (DAB), the FI Channel (Fast Information Channel) in particular. Moreover, transmission of the messages is provided via mobile radio telephone networks, for which the broadcast channel and the SMS channel (SMS—Short Message Service) are suitable. In this regard, a Global Automotive Telematic Standard (GATS) is being developed at the present time. This is a packet-oriented data channel which can be operated concurrently with voice transmission via telephone. While all TMC messages must be transmitted in sequence in broadcasting systems, i.e., in unidirectional networks, transmission on request is possible with bidirectional networks.

Each TMC message is stored in memory in the particular receiver and it stays there until it loses its validity. This is implicitly the case after a quarter of an hour (after half an hour with transmission via GSM). For greater time spans, the validity time is included explicitly in the transmission, for example, "two more hours." If an impediment lasts longer than was assumed at the beginning, the same message is sent again before it loses its validity (update message).

Traffic jams are normally reported with an extent in kilometers. However, the driver is frequently more interested in information about how much longer the traffic jam or other traffic impediment will last. When deciding whether to take a detour, which is normally more complex than the direct route, the expected duration of a traffic jam is one important consideration.

SUMMARY OF THE INVENTION

An object of the present invention is to provide the driver with information concerning the development of a traffic jam or of a different impediment based on the received TMC messages.

This objective is attained according to the present invention in that a time stamp is stored in memory with each of the received traffic messages, a measure of the duration of the event and/or the change of the extent is derived from the extents and the time stamps of several stored traffic messages relating to the same event, and the change is displayed. Although other obstructions developing over time may also be the object of the method of the present invention, it is preferably provided that the extent is the length of a traffic jam.

Various time stamps as such can be provided for the method according to the present invention which, for example, start at a time t=0 when the first traffic congestion message relating to an event is received. In the method according to the present invention, however, it is altogether advantageous if the time stamp is the particular clock time.

The change can be displayed optically or audibly, both a general trend display as well as a more precise display, for example, in kilometers per unit of time, being possible.

For example, the method according to the present invention makes clear the significance of the announcement of a traffic jam of perhaps only 5 kilometers in length but which has already been present in memory for several hours and in which the length of the traffic jam has possibly even been increased through an update message (which arrives at the same position in the TMC memory). This traffic jam is very stubborn and is worth circumventing. Also other messages such as road closings can be evaluated in a more practical manner in comparison to the mere statement "road closed."

To avoid overwriting earlier time stamps, one advantageous embodiment provides that subsequent messages relating to the same event are given the time stamp of the first message relating to that event.

In navigation devices with automatic route search, a resistance value is assigned to the individual roads. In the method according to the present invention, the time duration information as well as the change of the extent are suitable for use as a resistance value for a route search.

BRIEF DESCRIPTION OF THE DRAWINGS

FIG. 1 shows a table of TMC messages for a first event which have been received and stored in memory.

FIG. 2 shows the content of TMC messages for an additional event which have been received and stored in memory.

DETAILED DESCRIPTION

Figure 3:
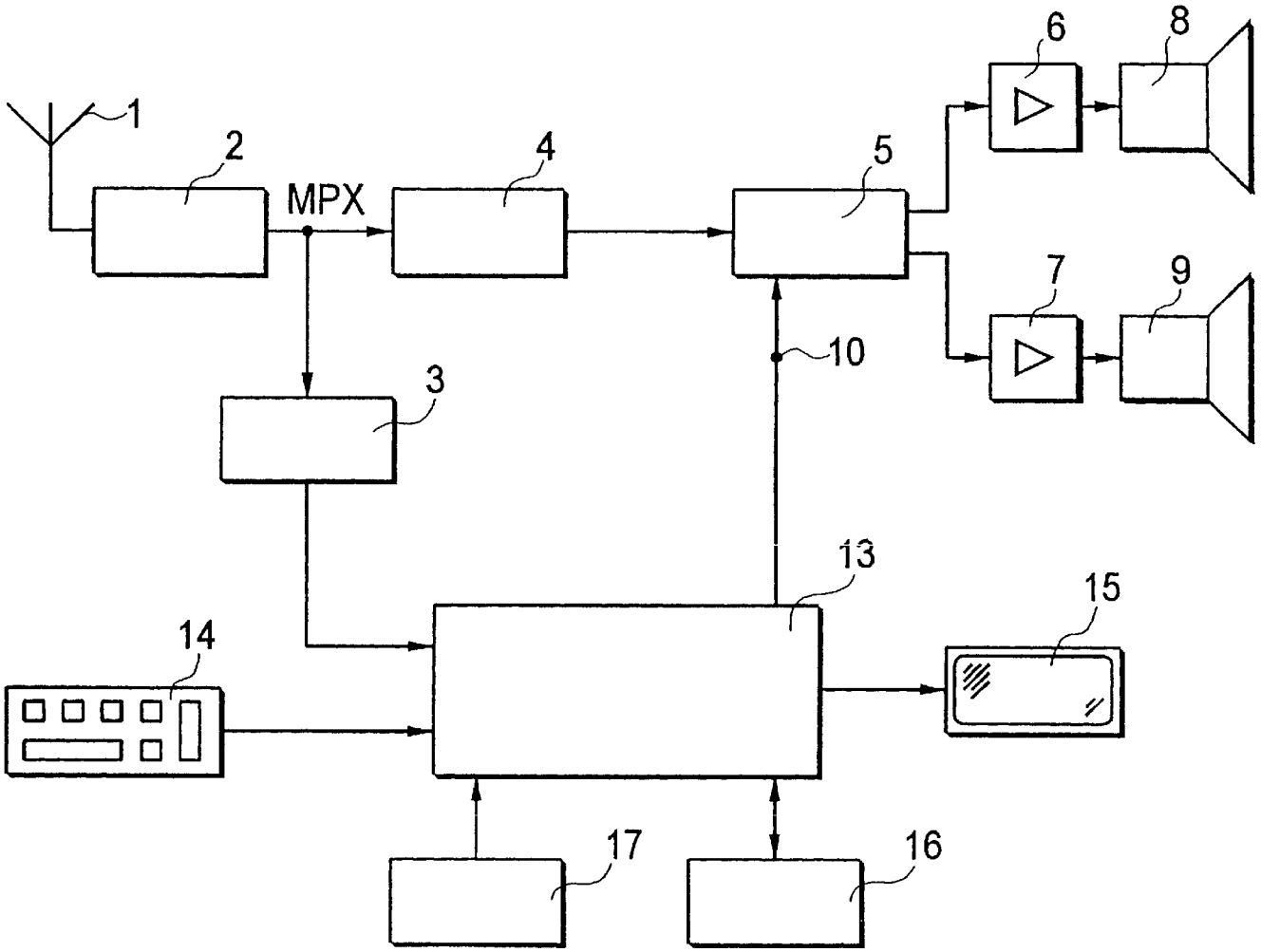
FIG. 3 shows a schematic block diagram of a receiver suitable for the method according to the present invention.

In the table according to FIG. 1, it is assumed that a new message with the content "5 km traffic jam on Ax between . . . and . . . " is received and provided with the time stamp TST=12:00 p.m. In this connection Ax signifies a road number. The dots stand for locations on the road, connecting points of an expressway in particular. This message was updated twice, specifically at 12:25 p.m. and at 12:50 p.m.

and in each case was identified as an update message according to ALERT C-Standard. The time stamp is then retained because the newly arrived message is an update message. Upon arrival, the trend "unchanged" is derived from the non-changing quantity (extent) of the traffic jam and is displayed in a suitable manner. If, for example, a message is to be output at 1:05 p.m., it is evident from the time stamp that the message has already been present for an hour and five minutes; however, the traffic jam is not becoming longer.

In the example shown in FIG. 2, a new message arrives at 3:00 p.m. and receives this clock time as time stamp TST. Update messages arrive at 3:25 p.m. and at 3:50 p.m.; however, they contain information concerning the increasing length of the traffic jam. For that reason, when the update messages arrive, the trend "increasing" is derived in each case. The output at 3:55 p.m. then contains the information that the message has already been present for 55 minutes and in addition, the traffic jam is becoming longer. In this case it is reasonable to follow a recommended detour.

FIG. 3 shows a receiver—preferably a car radio—suitable for the method according to the present invention. In a manner known per se, an antenna 1 is connected to a receiver component 2, at whose output a stereo multiplex signal MPX is present which is fed to a stereo decoder 4 and to an RDS decoder 3. Outputs of stereo decoder 4 are connected to an AF amplifier 5, to which speakers 8, 9 are connected via output stage 6, 7, respectively.

The RDS decoder selects RDS signals from the multiplex signal and decodes them. A microprocessor 13 performs a number of functions including the control of the entire receiver, only those functions being named below that are crucial for the method according to the present invention. Microprocessor 13 receives RDS signals from the RDS decoder and is connected to a control panel 14, a display 15, a memory 16 and a clock 17. The received TMC messages are, as shown in FIGS. 1 and 2, stored in memory 16. For the output of the TMC messages, display 15 can be activated by microprocessor 13. However, a voice output, e.g., in the form of voice synthesis is also possible, for which purpose, the synthesized audio signals can be fed to AF amplifier 5 via an input 10.

Various programs that carry out the individual operations are executed in microprocessor 13. Thus, for example, when a new TMC message arrives, the clock time is read out of clock 17 and stored in memory 16 together with the received TMC message. If an update message arrives, time stamp TST stored in connection with the new message is read out of memory 16 and stored in memory together with the new message. For output of this stored update message, it is read out of memory 16 and output via display 15 and/or speaker 8, 9. In so doing, the events (contents) of the update message and the previously received update message or of the new message received earlier are compared and the trend determined and output as well.

What is claimed is:

1. A method of informing a motor vehicle driver, comprising the steps of:

receiving and buffering digitally coded traffic messages;

storing a time stamp in a memory with each of the received traffic messages;

deriving at least one of: (a) a measure of a duration of an event and (b) a change of an extent, from extents and time stamps of a plurality of stored traffic messages relating to a same event; and displaying the change.

2. The method according to claim 1, wherein the extent is a length of a traffic jam.

3. The method according to claim 1, wherein the time stamps include a particular clock time.

4. The method according to claim 1, further comprising the step of providing subsequent messages relating to the same event with the time stamp of a first message relating to the same event.

5. The method according to claim 1, further comprising the step of using at least one of: (a) the measure of the duration of the event and (b) the change of the extent, as a resistance value assigned to a respective road for a route search.

* * * * *

UNITED STATES PATENT AND TRADEMARK OFFICE

CERTIFICATE OF CORRECTION

PATENT NO. : 6,477,459 B1
DATED : November 5, 2002
INVENTOR(S) : Wolfgang Wunderlich It is certified that error appears in the above-identified patent and that said Letters Patent is hereby corrected as shown below:

Column 4,
Line 23, insert -- external -- between “an” and “event”.

Signed and Sealed this

Sixteenth Day of September, 2003

JAMES E. ROGAN
*Director of the United States Patent and Trademark Office*